US005123474A

United States Patent [19]

Smith

[11] Patent Number: 5,123,474

[45] Date of Patent: Jun. 23, 1992

[54] ROLL-UP CLOSURE DEVICE

[76] Inventor: Richard C. Smith, 2137 Devon St., Port Charlotte, Fla. 33952

[21] Appl. No.: 699,357

[22] Filed: May 13, 1991

[51] Int. Cl.[5] ..... E06B 9/72; A47G 5/02

[52] U.S. Cl. ..... 160/310; 160/273.1

[58] Field of Search ..... 160/133, 272, 273.1, 160/310

[56] References Cited

U.S. PATENT DOCUMENTS

| | | | |
|---|---|---|---|
| 187,894 | 2/1877 | Osgood | 160/273.1 |
| 275,712 | 4/1883 | Roelofs | 160/273.1 |
| 3,640,332 | 2/1972 | Luby et al. | 160/133 |
| 3,797,553 | 3/1974 | Elliott | 160/273.1 X |
| 4,478,268 | 10/1984 | Palmer | 160/272 X |
| 4,487,244 | 12/1984 | Olson | 160/238 |
| 4,519,434 | 5/1985 | Forquer | 160/133 |
| 4,974,658 | 12/1990 | Komatsu et al. | 160/310 |

*Primary Examiner*—Carl D. Friedman
*Assistant Examiner*—Derek J. Berger
*Attorney, Agent, or Firm*—Frank A. Lukasik

[57] ABSTRACT

A roll-up garage closure device of flexible material such as insect screen which is rolled up on a tubular motor driven cylindrical, finned, aluminum roll drum supported by bearings on each end. The screen is attached to the roll drum within a groove formed between two adjacent fins while opposite vertical edges are hemmed over bead chain cording, captured by vertical tracks, and adapted to slide vertically up and down as the screen is rolled up on the drum. A crossbar, containing a semi-rigid guide, two steel bar weights, and a weather seal is attached to the bottom edge of the screen and pulls the screen down as the motor unrolls the screen.

6 Claims, 4 Drawing Sheets

ROLL-UP CLOSURE DEVICE

BACKGROUND OF THE INVENTION

1. Field of the Invention

This invention relates generally to a flexible closure panel and, more particularly, to a type thereof adapted for closing a substantially rectangular opening in a wall by a winding up and winding off action, said closure being operable to close the respective opening and being secured against leaving its lateral guides.

2. Discussion of the Prior Art

There are numerous closure structures, especially for openings in a building. One such closure is disclosed in U.S. Pat. No. 4,175,608 to Alten which uses a closure body adapted to be wound up and off and is characterized primarily in that the securing elements are detachably connected to the rim portions of the closure body, adapted to be conveyed to the closure body to be wound off, and are adapted to be withdrawn from the closure body to be wound off.

Another door structure is disclosed in U.S. Pat. No. 4,478,268 to Palmer which discloses a door for closing vehicular traffic passages in which the door is a curtain fabricated from a hard flexible material. The curtain runs in opposing channels, is mounted on a counterbalanced wind-up drum and under impact changes weight, moves out of the channel and is wound up to open the vehicular passage.

U.S. Pat. No. 3,460,602 to Hugus discloses a flexible closure tensioning device employing a flexible membrane fastened to a bottom rail which is movable towards and away from an upper roller on which the membrane wraps and unwraps itself as the closure opens and closes. The device includes a spring and cable system co-acting together with the upper roller and the bottom rail away from the roller, whereby tension is applied to the flexible member in all positions of the lower marginal edge of the latter.

U.S. Pat. No. 3,878,879 to Manns discloses a roll-up door wherein the door-leaf is flexible and arranged to be wound about a roller into open position. The door-leaf is maintained in a stretched condition laterally by means of trolleys having grooved wheels running in contact with guide rails provided in vertical side frames. The weight of the door-leaf may be completely balanced, making it possible to operate the door manually.

The use of flexible panels as closure members, such as doors for relatively large openings in buildings has been severely restricted by the size of the opening. In a common procedure for opening and closing this type of door, an elongated cylinder, often a hollow shaft, is located at the upper edge of the opening and the flexible panel is rolled upon the shaft when the door is opened. However, where the door is of extensive width, and or the door opening is especially high, serious problems are encountered in effecting support of the panel supporting cylinder between the ends thereof. Regardless of the measures taken, it has been heretofore necessary to physically engage the panel on the cylinder at the lower surface thereof at intervals along the cylinder and, obviously, this has resulted in excessive wear at the locations of such support. Furthermore, because of the concentration of pressure between the support means, such as rollers, and the fabric rolled on the cylinder, a puckering or gathering of the panel during the rolling or unrolling thereof from the cylinder has not only increased the wear, but often has given the panel an unsightly appearance. Previous attempts, as shown by the prior art, have been largely self defeating. Attempts to make the cylinder or shaft entirely supported at its ends have resulted in excessive increases in the weight of the shaft, hence its supporting structure.

In addition to the self-defeating aspect of previous attempts to solve the problem, such attempts have always resulted in an increase in cost which has been substantial and usually unacceptable.

Accordingly, it is an object of this invention to improve the above mentioned doors in such a way that the closure body can be wound up to a roll of relatively small diameter.

A further object of this invention is to provide a simple, flexible, closure device for various size and shape openings.

A still further object of this invention is to provide a roll mechanism with a guide track which seals out undesired matter or insects.

Yet another object of this invention is to provide a closure device which can be opened and closed easily by manual, remote or automatic means.

These and other objects of the invention will become apparent to those skilled in the art to which the invention pertains when taken in light of the annexed drawings.

DESCRIPTION OF THE PREFERRED EMBODIMENT

The present invention is directed to a roll-up garage closure device of flexible material such as insect screen which will allow light and fresh air in but keep out unwanted items such as insects, certain types of radiation, etc. The flexible closure material is rolled upon a cylindrical, ribbed, roll drum supported by a bearing on one end and which is rotated by a tubular motor supported by a bearing at a second end. The flexible closure material is attached to the roll drum within a groove formed between two adjacent ribs while opposite vertical edges are hemmed over bead chain cording, captured by vertical guide tracks and yet able to slide vertically up and down as the closure is rolled up on the drum. The bottom horizontal side of the closure material is attached to a crossbar which has guides attached to the ends, wrapped around the vertical hemmed edge, and guided by the vertical guide tracks. Attached to the bottom edge of the crossbar is a flexible seal which seals the bottom horizontal side of the flexible closure against the bottom horizontal side of the opening. Thus rotating the roll tube rolls up the flexible closure material guided by the guide tracks to cover and uncover the large opening while allowing the opening to be closed and sealed along the total perimeter of the opening when the flexible closure material is unrolled in its down position.

The advantages of this invention are that it is a flexible closure device for large openings which eliminates the drawbacks of the prior art devices. It allows the opening to be closed in an automatic, motorized and/or remote means as well as manually. The flexible closure material is stored neatly out of the way when the device is open and has a relatively tight and neat appearance when it is closed. There is no bottom track necessary because the closure device is weighted and has a seal attached thereto which seals at the bottom when the device is closed. Vertical perimeter seals are accomplished by vertical guide tracks and the top storage device provides the seal at the top perimeter of the opening. The total opening is sealed against undesirable elements when closed yet the total opening is exposed when the device is opened.

Figure 1:
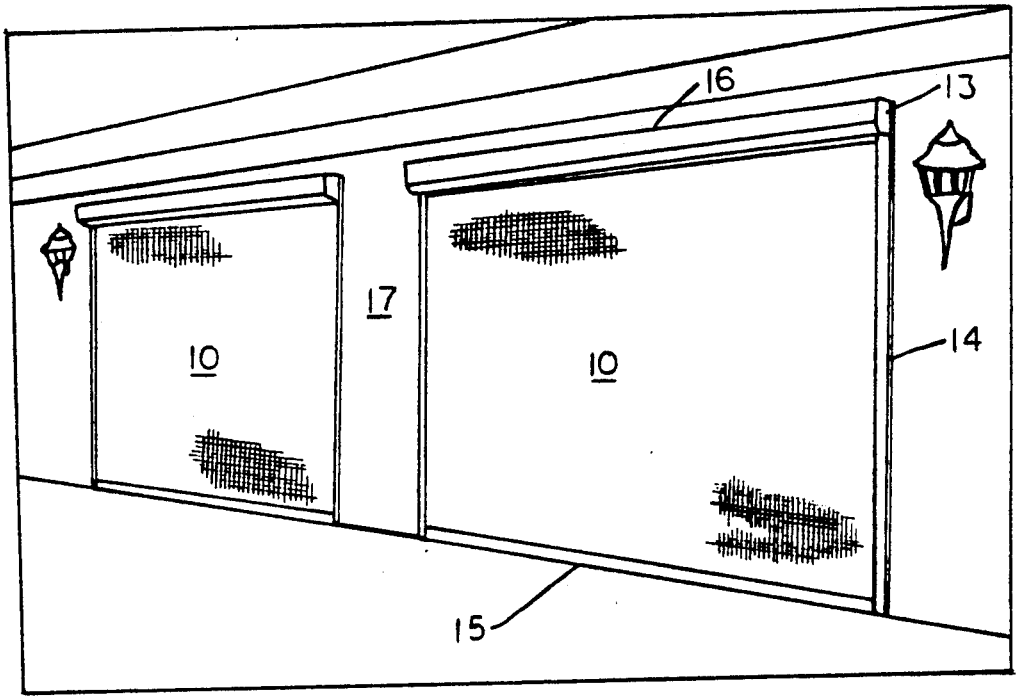
FIG. 1 is a perspective view of two closure devices of the invention installed in a house.
Figure 2:
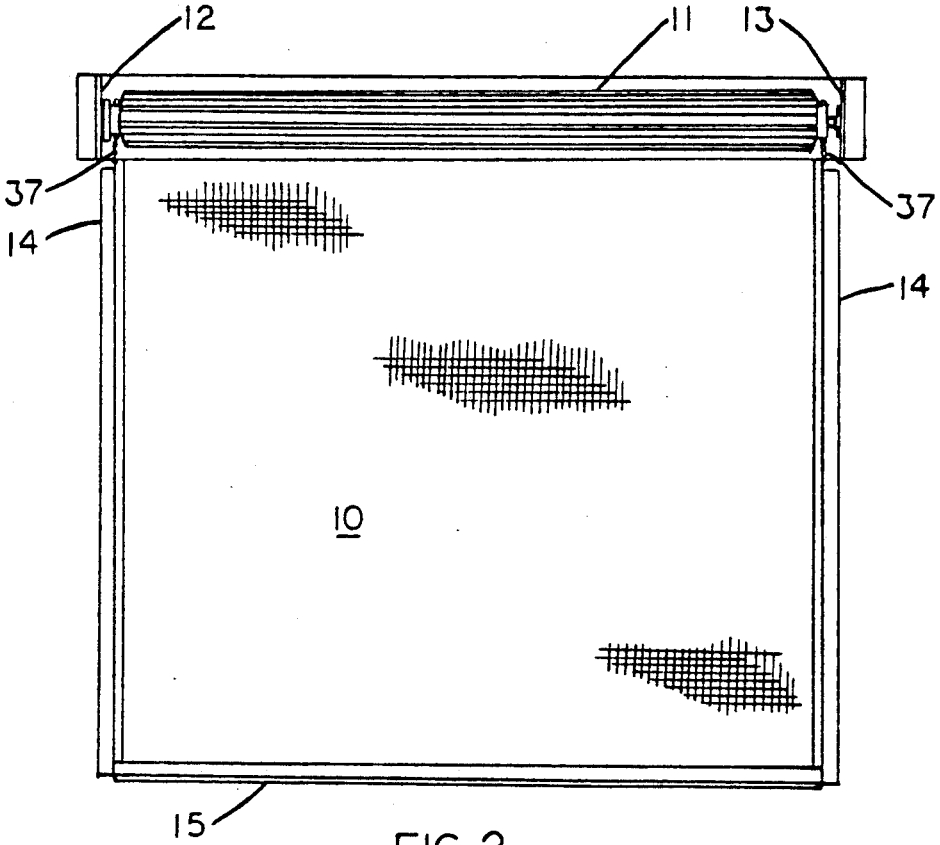
FIG. 2 is a front view of a closure device installation with cover removed.
Figure 4:
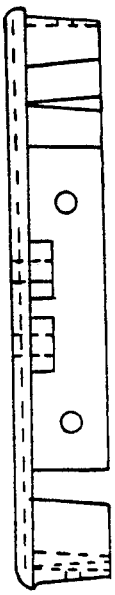
FIG. 4 is a front view of an end cap.
Figure 3:
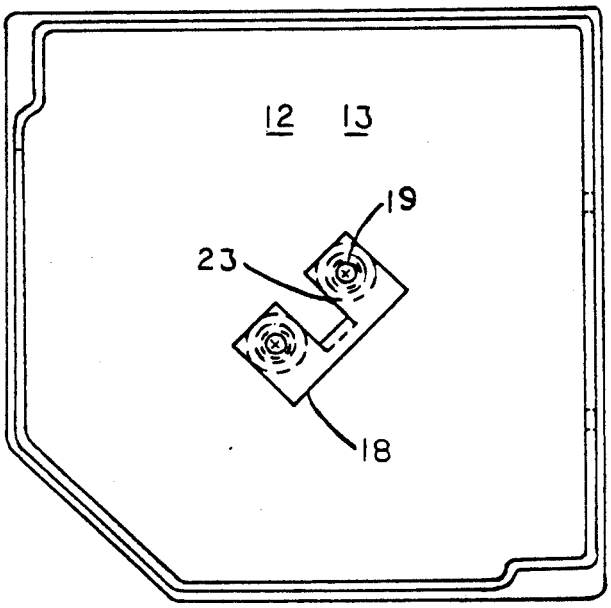
FIG. 3 is a side view of an end cap.
Figure 5:
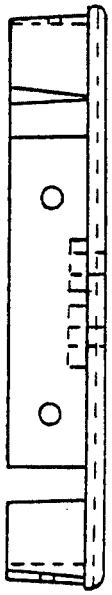
FIG. 5 is a rear view of an end cap.
Figure 9:
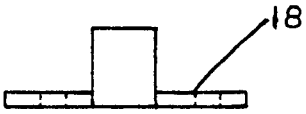
FIG. 9 is a top view of the universal end bracket.
Figure 8:
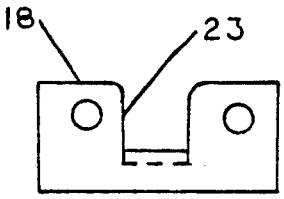
FIG. 8 is a front end view of the universal end bracket.
Figure 10:
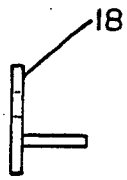
FIG. 10 is an end view of the universal end bracket.

As shown in FIGS. 1 and 2, flexible closure material 10, roll drum 11, end caps 12 and 13, vertical guide tracks 14, crossbar 15 and cover 16 are assembled and fastened to the exterior of garage 17 door opening. FIGS. 3, 4, and 5 show details of end caps 12 and 13 having universal end brackets 18, shown in FIGS. 8-10, fastened thereto with screws 19. End caps 12 and 13 may preferably be made from cast metal such as aluminum or steel.

Figure 7:
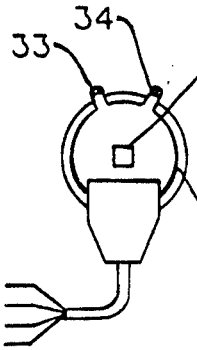
FIG. 7 is a front end view of the tubular motor operator.
Figure 6:
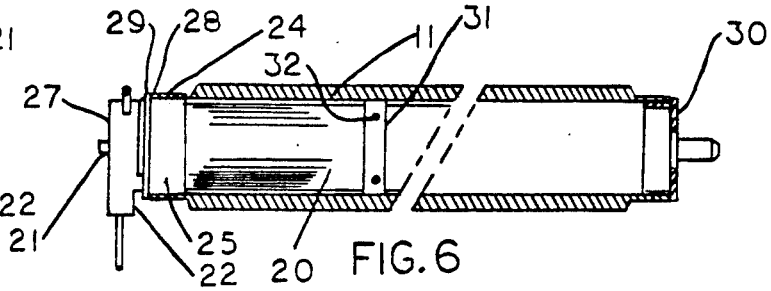
FIG. 6 is a side view of a tubular motor assembled in the roll drum of the invention, partially in section.

FIGS. 6 and 7 show details of the assembly of tubular motor 20 and roll drum 11. Motor square stud 21, on operator 22, when assembled in notch 23 of universal end bracket 18, provides a firm base for tubular motor 20 to drive roll drum 11 when assembled. In a preferred embodiment, a SOMFY 522E tubular motor, manufactured by Somfy Systems Inc., Edison, N.J. 08817 was used. A motor limit switch contained in operator 22 is controlled by a raised key 24 located on the limit switch crown 25. The roller drum 11 contains a notch 26 to provide the mechanical linkage between the roller drum 11 and the motor limit switch 27. The roller drum 11 spans from the inside lip 28 of crown 29 to the inside lip of the idler end cap 30. Roller drum 11 is driven through a connection made by motor drive wheel 31 fastened to roller drum 11 with rivets 32. Limit switch 27 is set in its top and bottom positions by thumbscrews 33 and 34. Seven turns of the thumbscrews 33 and 34 equal one full turn of the motor drive wheel 31.

Figure 12:
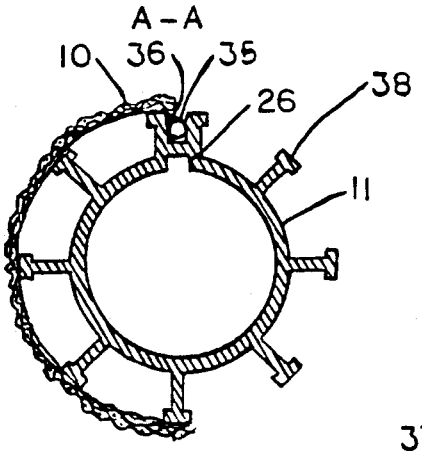
FIG. 12 is a sectional view of the roll drum taken along line A—A.
Figure 11:
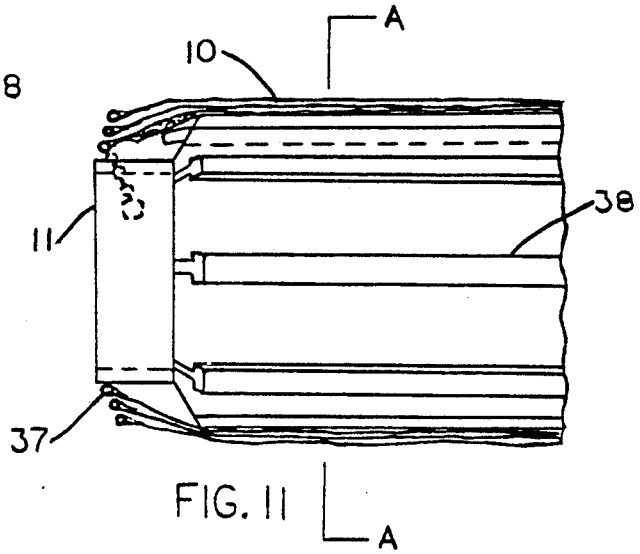
FIG. 11 is a side view of an end section of the roll drum of the invention.
Figure 16:
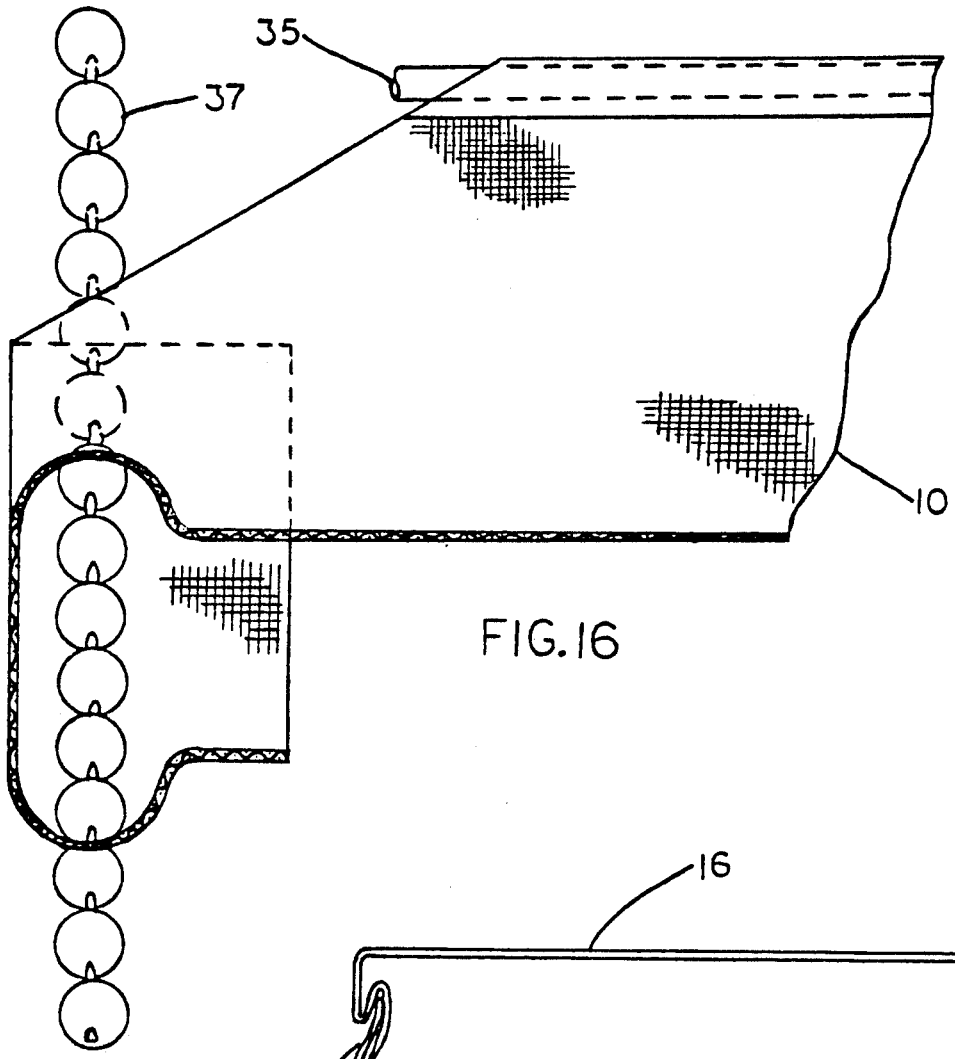
FIG. 16 is a front view of the assembly of bead chain cording and the flexible closure material partially in section.

FIGS. 11 and 12 show the flexible closure material 10 in section, as it is wrapped around roller drum 11. The top edge of material 10 is wrapped around spline 35 and inserted into groove 36 in roller drum 11. Bead chain cording 37 is fastened to roller drum 11 to assist in wrapping the flexible closure material 10 around drum roller 11. The assembly of the flexible closure material 10 to the bead chain cording 37 is shown in FIG. 16. Bead chain cording 37 material is interlocking bead chain. As the roller drum 11 is rotated opening and closing, the cording 37 must be free within the hemmed flexible closure material 10 to rotate and move laterally through the hem in order that the hemmed edge moves freely through the vertical guide tracks 14. The interlocking bead chain cording 37 will compress and elongate as well as rotate freely thereby allowing for self alignment within the guide tracks 14.

In a preferred embodiment, roller drum 11 is formed from extruded aluminum and radially spaced fins 38 are formed along the entire length. As shown in FIG. 11, the fins 38 are removed from each end of roller drum 11 to provide sufficient room for stacking layers of the bead chain cording 37 as the flexible closure material 10 is wound onto roller drum 11.

In a preferred embodiment, the outside diameter of the fins 38 was 3", the inner diameter of the drum 11 was 1.850", and the width of the fins 38 was 0.090". The fins 38 were spaced circumferentially at 45° from each other.

Figure 13:
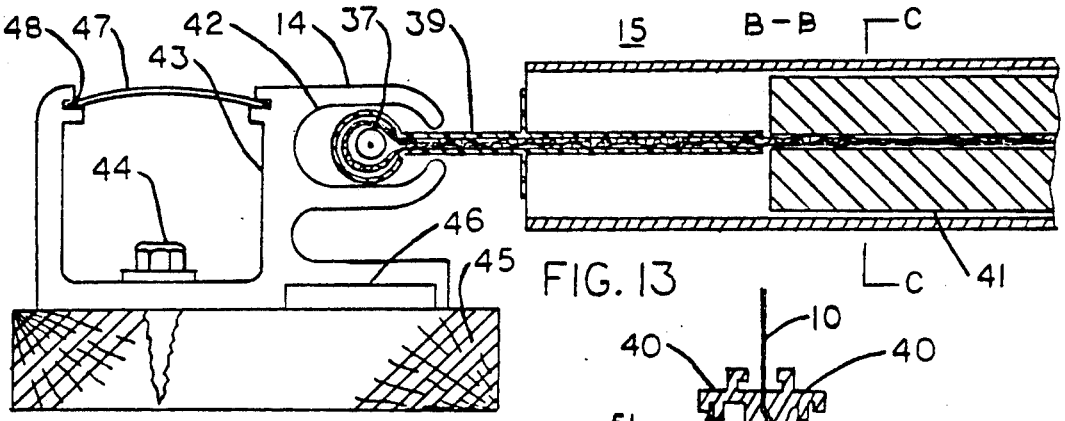
FIG. 13 is a top view of a cross bar assembly.

Referring now to FIG. 13, the assembly of crossbar 15, semi-rigid guide 39, and vertical guide track 14 is shown. Crossbar 15 comprises two identical mating parts 40 having weights 41, guide 39 sized to fit between mating parts 40, and flexible closure material 10 clamped together and fastened with screws or rivets to form a rigid, heavy, bottom edge to guide and pull the flexible closure material 10 down as the tubular motor is being operated in the down mode. Semi-rigid guide 39 may be made from U.V. resistant vinyl and is used to align the flexible closure material 10 in the vertical guide tracks 14. Guide 39 is necessary to prevent excessive wear at the point of high stress between the crossbar 15 and the guide tracks 14 and to distribute the load on the flexible closure material 10 across the whole opening.

After assembly, cover 51 is inserted in grooves 52 to provide a cover for the assembly and cross bar seal 53 is inserted in grooves 54 to seal out the elements. The rigid crossbar 15 is designed to hold the guide 39 in precise alignment with the guide tracks 14 and to allow the flexible closure material 10 to be held precisely along the lateral center line of the crossbar 15 in such a way as to keep the axial center of the guide 39 in the axial center of the guide tracks 14. Guide 39 is further designed to hold the weights 41 on either side of the screen for balance and located at opposite ends of the crossbar 15 such that the downward force of the crossbar 15 is primarily at the bearing ends of the roller drum 11. This minimizes excess weight in the center of the assembly causing bowing of unsupported roller drum 11. Eliminating this "bowing" over large openings keeps the storage enclosure small and a tight appearance to the flexible closure material 10 without the need for complicated center support devices.

The exposed end of guide 39 is inserted into "C" shaped channel 42 of vertical guide track 14. Guide tracks 14 are made from a rigid material such as vinyl. The hemmed, flexible closure material 10 along with the bead chain cording 37 is larger than the opening of the "C" but smaller than the inside diameter. The "C" section is elongated away from the opening to compensate for thermal expansion of the crossbar 15 over the widest possible temperature range.

Vertical guide "U" shaped channel 43 of vertical guide track 14 is used to contain mounting screws 44 to fasten vertical guide 14 to the mounting surface 45. Guide track seal channel 46 is used to provide a seal against the elements. After the vertical guide tracks are fastened to the mounting surface 45, the opening is closed by inserting mounting screw cover 47 into guide slots 48 to provide a decorative cover. In a preferred embodiment, cover 47 was made from ivory colored, rigid vinyl and cross bar 15 cover 51 was made from black, rigid vinyl, and vertical guide tracks 14 were made from ivory, U.V. resistant vinyl.

Figure 15:
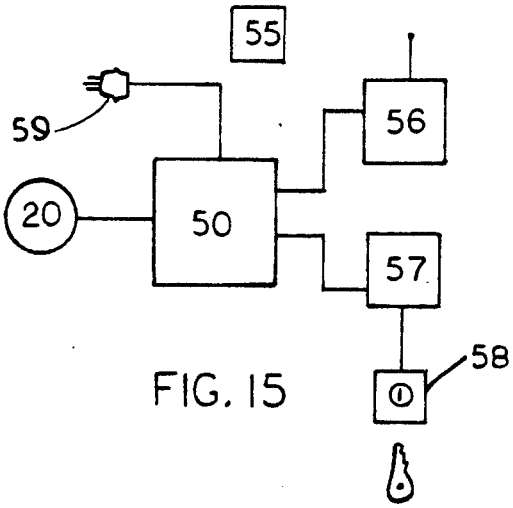
FIG. 15 is a single motor remote control wiring diagram.
Figure 14:
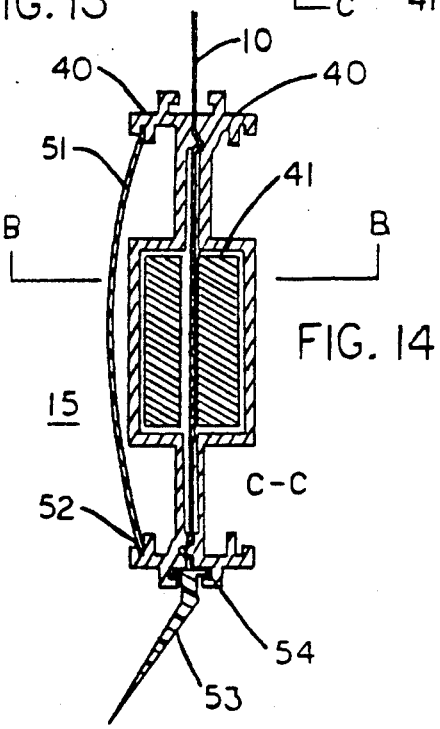
FIG. 14 is a side view of a cross bar assembly in section.

FIG. 15 discloses a single motor remote control wiring diagram which comprises a remote transmitter 55, a plug-in radio receiver 56, a remote wall switch 57, and lock 58. The receiver 56 and remote wall switch 57 are wired to remote controller 55 as shown in FIG. 15. Power is brought in through power cord 59 into remote controller 55. The receiver 56 and remote wall switch are wired into remote controller 55. After the wiring is completed, the thumbscrews 33 and 34 are used to set the upper and lower limits of the closure device of the invention. If the device retracts further than the desired position, the "UP" thumbscrew is turned in the negative direction. The device is then extended and retracted to check for correct positioning. If the device does not retract to the desired position, the "UP" thumbscrew is turned in the positive direction while the switch 57 is pressed in the UP position. The opposite steps are followed to set the open position.

Figure 17:
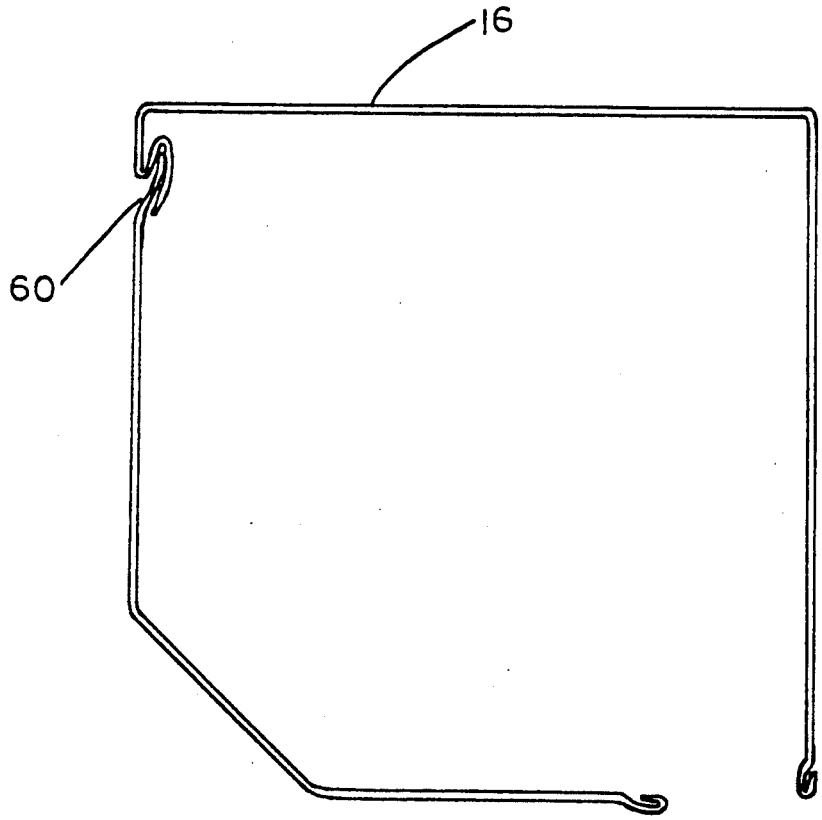
FIG. 17 is a side view of the two piece cover of the invention.

FIG. 17 shows a side view of cover 16 which is fabricated in two parts and made from 0.032 aluminum, and generally painted in white, ivory or bronze although other colors are optional. The cover 16 is fastened to end caps 12 and 13 and overlapped as at 60.

The roll-up closure device of the invention is available for single and two-car garages with seven foot openings and 8, 9, 10, 12, 14, and 16 foot standard widths. The device generally mounts to the exterior of the garage and rolls up into a 6"×6" enclosure slightly longer than the garage door opening. The enclosure is constructed from an attractive wood grain aluminum enclosure and mounts over the door close to the soffit. The vertical edges of the screen are held in place in small guide tracks which keeps insects out and guides the screen down. The bottom of the screen has a flexible vinyl seal to seal the bottom of the door against insects. The device requires no threshold track to collect dirt and impede cleaning of the garage.

In a preferred embodiment, the flexible closure material 10 comprised an 18×14 mesh, charcoal colored, vinyl coated fiberglass screen. The flexible closure material 10 is hemmed as shown in FIG. 16 and may be stitched or glued to form the hem. An all purpose cement, such as the type used for joining PVC, CPVC, ABS and Styrene pipe and fittings, may be used to seal the hemmed edge. In other embodiments, SOLAR SCREEN, FLORIDA GLASS or 20×20 insect screen or a combination thereof were used.

While the invention has been explained with respect to a preferred embodiment thereof, it is contemplated that various changes may be made in the invention without departing from the spirit and scope thereof.

What I claim is:

1. A roll-up closure device especially for buildings, which includes wall means comprising two substantially parallel vertical side wall sections spaced from each other in a horizontal direction and also comprising at least one horizontal wall section interconnecting said vertical side wall sections and defining therewith a wall opening, said device comprising:

motor driven cylindrical, ribbed, extruded aluminum roller drum means affixed to said horizontal wall section, said roller drum having a groove formed therebetween two adjacent ribs, bead chain cording means having an upper end and a lower end, said cording means upper end being secured to said roller drum means, a flexible closure material having an upper end and a lower end and side edges, said upper end being secured to said roller drum means within said groove for moving said closure material upwards, and said side edges being hemmed over and glued to the entire length of said bead chain cording means, a pair of parallel spaced apart vertical guide means supported by said side wall sections for guiding said closure material side edges during vertical movement, said vertical guide means each having elongated "C" shaped channels therein, weighted crossbar means secured to said closure material lower end and slideably engageable at a first and a second end with said vertical guide means, said crossbar means including, means for restraining movement of said closure material side edges out of said vertical guide means, and weight means for moving said closure material downwards.

2. A roll-up closure device according to claim 1, wherein said motor driven roller means comprises:

a tubular electric motor secured inside an extruded aluminum tube having radially extending fins spaced circumferentially at 45° from each other, said fins being removed a sufficient distance from each end to permit stacking of said cording means.

3. A roll-up closure device according to claim 1, wherein said flexible closure material comprises vinyl coated fiberglass screen.

4. A roll-up closure device according to claim 1, wherein said side edges are hemmed over and scaled with vinyl sealing cement.

5. A roll-up closure device according to claim 1, wherein said crossbar means consists of, two extruded aluminum mating parts, two steel bar weights, and a semi-rigid vinyl guide.

6. A roll up closure device especially for buildings, which includes wall means comprising two substantially parallel vertical side wall sections spaced from each other in a horizontal direction, and also comprising at least one horizontal wall section interconnecting said vertical side wall sections and defining therewith a wall opening, said device comprising:

a cylindrical ribbed, aluminum roller drum affixed to said horizontal wall section, said roller drum having radially extending fins spaced circumferentially at 45° from each other, and a groove formed between two adjacent ribs, a tubular electric motor secured inside said roller drum, bead chain cording means upper end being secured to said roller drum means, vinyl coated fiberglass screen means having an upper end and a lower end and side edges, said upper end being secured to said roller drum within said groove for moving said screen means upwards, and said side edges being hemmed over and glued to the entire length of said bead chain cording means, a pair of parallel spaced apart vertical guide means supported by said side wall sections for guiding said screen means side edges during vertical movement, said vertical guide means each having elongated "C" shaped channels therein, crossbar means consisting of two extruded aluminum parts, two steel weights, a semi-rigid guide, and a vinyl weather seal, said aluminum parts being clamped together and fastened to the lower end of said screen means to form a rigid, heavy, bottom edge to guide and pull said screen means as said tubular motor is being operated in a down mode.

* * * * *